US007284878B2

(12) United States Patent
Dorogi et al.

(10) Patent No.: US 7,284,878 B2
(45) Date of Patent: Oct. 23, 2007

(54) LUMEN REGULATING APPARATUS AND PROCESS

(75) Inventors: Michael Jay Dorogi, Newark, OH (US); Eric Seth Perkins, Reynoldsburg, OH (US); Luke Jonathon Siefker, Columbus, OH (US); Terry Alan Richards, Nashport, OH (US)

(73) Assignee: Acuity Brands, Inc., Atlanta, GA (US)

( * ) Notice: Subject to any disclaimer, the term of this patent is extended or adjusted under 35 U.S.C. 154(b) by 49 days.

(21) Appl. No.: 11/004,481

(22) Filed: Dec. 3, 2004

(65) Prior Publication Data

US 2006/0120072 A1 Jun. 8, 2006

(51) Int. Cl.
*F21V 7/20* (2006.01)

(52) U.S. Cl. ..... 362/218; 362/260; 362/294; 362/373; 362/371

(58) Field of Classification Search ..... 362/217, 362/218, 260, 264, 294, 373, 369, 370, 371
See application file for complete search history.

(56) References Cited

U.S. PATENT DOCUMENTS

| | | | | |
|---|---|---|---|---|
| 2,933,596 | A * | 4/1960 | Tolbert | 362/294 |
| 2,966,602 | A | 12/1960 | Waymouth et al. | 313/44 |
| 3,112,890 | A | 12/1963 | Snelling | 240/51.11 |
| 3,192,724 | A | 7/1965 | Cummings | 62/3 |
| 3,284,664 | A | 11/1966 | Morin et al. | 315/108 |
| 3,309,565 | A | 3/1967 | Clark et al. | 315/117 |
| 3,330,180 | A * | 7/1967 | Ferguson et al. | 399/92 |
| 3,965,345 | A * | 6/1976 | Fordsmand | 362/218 |
| 4,070,570 | A | 1/1978 | Wetmore et al. | 362/218 |
| 4,401,912 | A | 8/1983 | Martzloff et al. | 313/17 |
| 4,449,071 | A | 5/1984 | Yokoyama | 315/53 |
| 4,518,895 | A | 5/1985 | Lehman | 317/117 |
| 4,529,912 | A | 7/1985 | Northrup et al. | 315/117 |
| 4,533,853 | A | 8/1985 | Hammond et al. | 315/117 |
| 4,533,854 | A | 8/1985 | Northrup | 315/117 |
| 4,746,832 | A | 5/1988 | Grossman et al. | 313/22 |
| 4,750,096 | A | 6/1988 | Lim | 362/218 |
| 4,978,890 | A | 12/1990 | Sekiguchi et al. | 315/117 |
| 5,006,752 | A | 4/1991 | Eggink et al. | 313/161 |
| 5,130,912 | A | 7/1992 | Friederichs et al. | 362/263 |
| 5,161,884 | A | 11/1992 | Siminovitch | 362/294 |
| 5,174,646 | A | 12/1992 | Siminovitch et al. | 362/218 |
| 5,229,842 | A | 7/1993 | Dolan et al. | 356/429 |
| 5,537,301 | A | 7/1996 | Martich | 362/218 |

(Continued)

OTHER PUBLICATIONS

Watanabe, et al., "Development of a Variable-Conductance Heat-Pipe for a Sodium-Sulfur (NAS) Battery," *Furukawa Review*, No. 20 (2001).

(Continued)

*Primary Examiner*—Sandra O'Shea
*Assistant Examiner*—Zahra I. Bennett
(74) *Attorney, Agent, or Firm*—Needle & Rosenberg, P.C.

(57) ABSTRACT

The present invention is a fluorescent light lumen regulating apparatus. More specifically, in one aspect, the present invention is a fluorescent lighting assembly for mounting at least one fluorescent lamp. In this aspect, the lighting assembly comprises a lamp housing. In another aspect, the invention further comprises a thermal dissipater to selectively dissipate heat from the fluorescent lamp to the ambient air to maintain the temperature of the cold spot of the fluorescent lamp within a predetermined temperature range.

34 Claims, 5 Drawing Sheets

U.S. PATENT DOCUMENTS

| | | | | |
|---|---|---|---|---|
| 5,581,157 | A | 12/1996 | Vrionis | 315/117 |
| 5,612,593 | A | 3/1997 | Olson | 315/117 |
| 5,651,609 | A | 7/1997 | Pelton et al. | 362/294 |
| 5,717,277 | A | 2/1998 | Siminovitch | 313/318.02 |
| 5,720,548 | A | 2/1998 | Geary | 362/260 |
| 5,773,926 | A | 6/1998 | Maya et al. | 313/490 |
| 5,808,418 | A | 9/1998 | Pitman et al. | 315/115 |
| 5,909,085 | A * | 6/1999 | Nelson | 315/94 |
| 6,024,465 | A | 2/2000 | Kobayashi | 362/218 |
| 6,123,145 | A | 9/2000 | Glezer et al. | 165/104.33 |
| 6,411,042 | B1 | 6/2002 | Cull et al. | 315/115 |
| 6,457,654 | B1 | 10/2002 | Glezer et al. | 239/4 |
| 6,578,988 | B2 | 6/2003 | Johnson et al. | 362/294 |
| 6,588,497 | B1 | 7/2003 | Glezer et al. | 165/84 |
| 6,682,381 | B1 | 1/2004 | Michael | 445/3 |
| 6,747,413 | B2 | 6/2004 | Cull et al. | 315/112 |

OTHER PUBLICATIONS

Xie, et al., "The Use of Heat Pipes in the Cooling of Portables with High-Power Packages," *Darnell Group, Inc.* (2000).

Delil, "Variable Conductance Heat Pipes: Modelling and Applications."

"Thermal Actuators:Solid Liquid Phase Change Actuators," *Therma-Omega-Tech, Inc.* (1997).

Caltherm, "Thermal Actuators," *Caltherm Corporation Thermal Actuators* (2005).

The Missile Defense Agency, "Linking American Businesses to Missile Defense Technology," *MDA Update* (2003).

Holophane Product Innovation Group, "T5 Fluorescent Lamp Thermal Management System," *Holophane* (2004).

* cited by examiner

LUMEN REGULATING APPARATUS AND PROCESS

FIELD OF THE INVENTION

The present invention pertains to the field of fluorescent lighting assemblies, and particularly, to lighting assemblies with cold spot regulating apparatuses.

BACKGROUND OF THE INVENTION

Fluorescent lamps are becoming increasingly popular in both commercial and residential applications. Fluorescent lamps are more energy efficient and last longer than traditional incandescent lights.

The visible light from a fluorescent lamp is produced by a mixture of phosphors inside the lamp. They give off light when exposed to ultraviolet radiation released by mercury atoms as they are bombarded by electrons. The flow of electrons is produced by an arc between two electrodes at the ends of the lamp.

The ambient temperature around a fluorescent lamp can have a significant effect on light output and lamp efficiency. The temperature of the coldest spot on the surface of the lamp is where mercury vapor will condense to liquid form, and this temperature (the "minimum lamp wall temperature") controls the vapor pressure inside the lamp. The optimum lamp wall temperature for fluorescent lamps ranges from about 10° C. to about 75° C., depending on the ambient temperature. At temperatures below the optimum, mercury vapor will condense at the cold spot, reducing the number of mercury atoms available to emit UV radiation. At temperatures above the optimum, an excess of mercury vapor is present, absorbing the UV radiation before it can reach the phosphors. In both cases, light output drops.

Not all fluorescent systems are equally susceptible to low-temperature problems, but in general, as temperature drops, so do light output and efficiency. At very low temperatures (below 32° F. or 0° C.), lamp output can decline to one-third the rated value or less. It is important to note that some fluorescent lamps will have to warm up a while before producing sufficient light under cold conditions, some may take several minutes to ignite, and some won't start at all.

For cold applications (either indoors or out), fluorescent lamps and ballasts can be designed specifically for low-temperature operation. These lamps are usually equipped with electronic ballasts and can be enclosed in globes or recesses to prevent wind chill of the lamp. Even with these precautions, the lamp will most likely not operate at the same efficiency and produce the same amount of light as it would under more hospitable ambient conditions. However, the heat produced by the lamp during use will generally be enough to increase the temperature of the lamp enough to make the lumen output sufficient.

High ambient temperatures may be produced around enclosed fluorescent lamps in interior lighting applications. In addition, less-efficient ballasts will introduce more heat into fixture enclosures. The IES Lighting Handbook points out that a 1% loss in light output (for fluorescent lamps in general) can be expected for every 2° F. (1.1° C.) above the optimum ambient temperature. Efficiency can also drop, to some degree, at these higher temperatures.

Some current state of the art lighting assemblies are equipped with heat dissipating devices that are designed to cool the fluorescent lamp housed within the lighting assembly to an optimum temperature. A problem with at least some of these devices is that the heat dissipating devices, when available, are always in cooling mode. Thus, for all ambient temperatures, the heat dissipating devices remove heat. Often, the cold spot of the fluorescent lamp is cooled below the optimum temperature. Therefore, what is needed is a fluorescent lighting assembly equipped with a heat dissipating device that keeps the fluorescent lamp within the desired temperature range across a larger range of ambient temperatures.

SUMMARY

The present invention is a fluorescent light lumen regulating apparatus. More specifically, the present invention is a fluorescent lighting assembly for mounting at least one fluorescent lamp, wherein the fluorescent lighting assembly comprises a lamp housing.

Additionally, one aspect comprises a thermal contactor mounted within the lamp housing to engage a cold spot of the fluorescent lamp. In one aspect, the thermal contactor comprises a thermally conductive material.

Another aspect of the invention further comprises a thermal dissipater in thermal contact with the thermal contactor. In this aspect, the thermal dissipater selectively dissipates heat from the fluorescent lamp to the ambient air to maintain the temperature of the cold spot of the fluorescent lamp within a predetermined temperature range. In one embodiment, the thermal dissipater is a variable conductance heat pipe.

In one aspect, the lighting assembly comprises a socket for engagement with a mounting end of the fluorescent lamp. In another aspect, the luminaire further comprises a socket receptacle for engagement with the socket. In this aspect, the socket receptacle is mounted to the lamp housing.

DETAILED DESCRIPTION OF THE DRAWINGS

These and other features of the preferred embodiments of the present invention will become more apparent in the detailed description, in which reference is made to the appended drawings wherein.

DETAILED DESCRIPTION OF THE INVENTION

Figure 1:
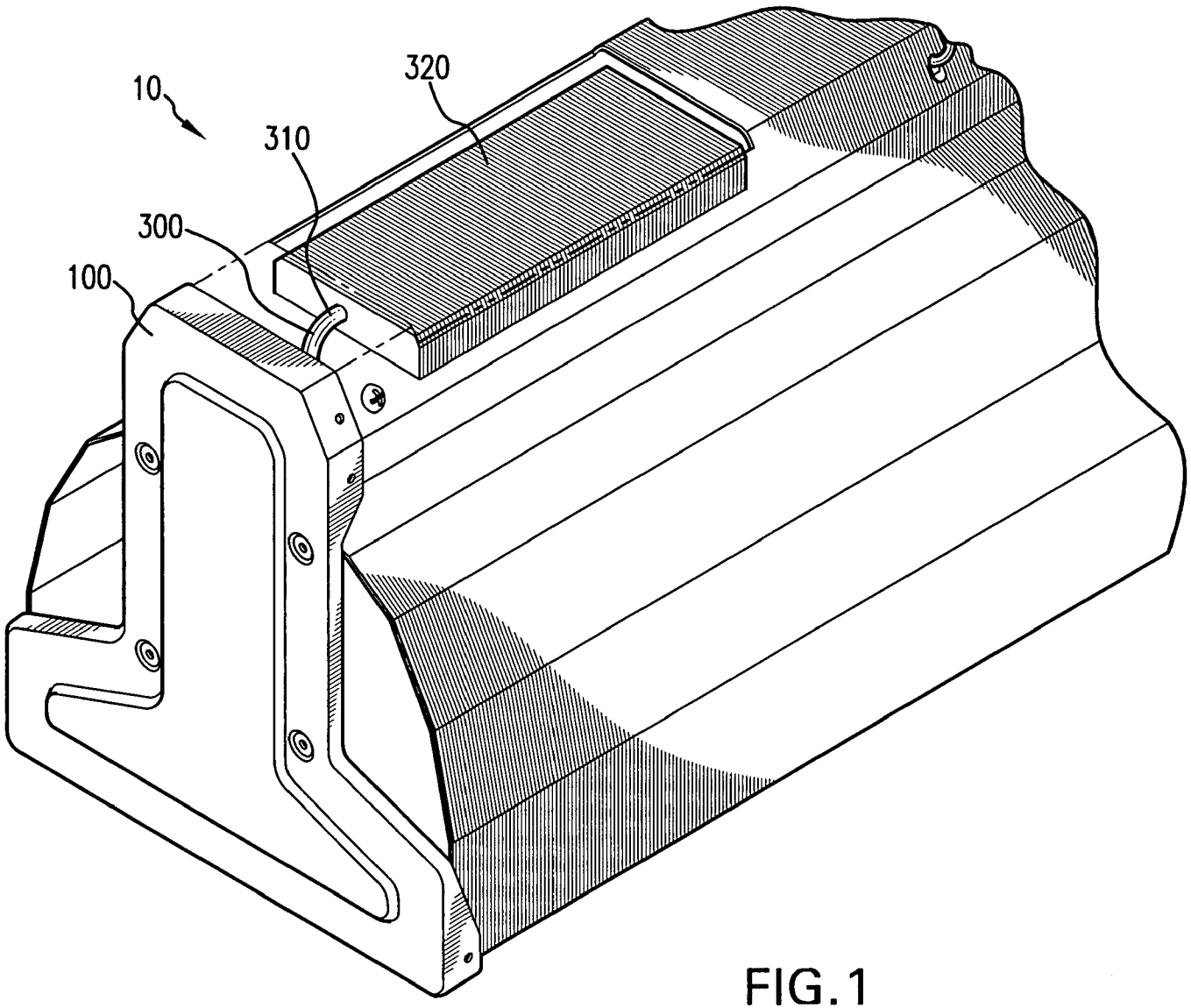
FIG. 1 is a partial perspective view of one embodiment of a fluorescent lighting assembly for mounting at least one fluorescent lamp showing a lamp housing and a thermal dissipater comprising a plurality of cooling fins.
Figure 2:
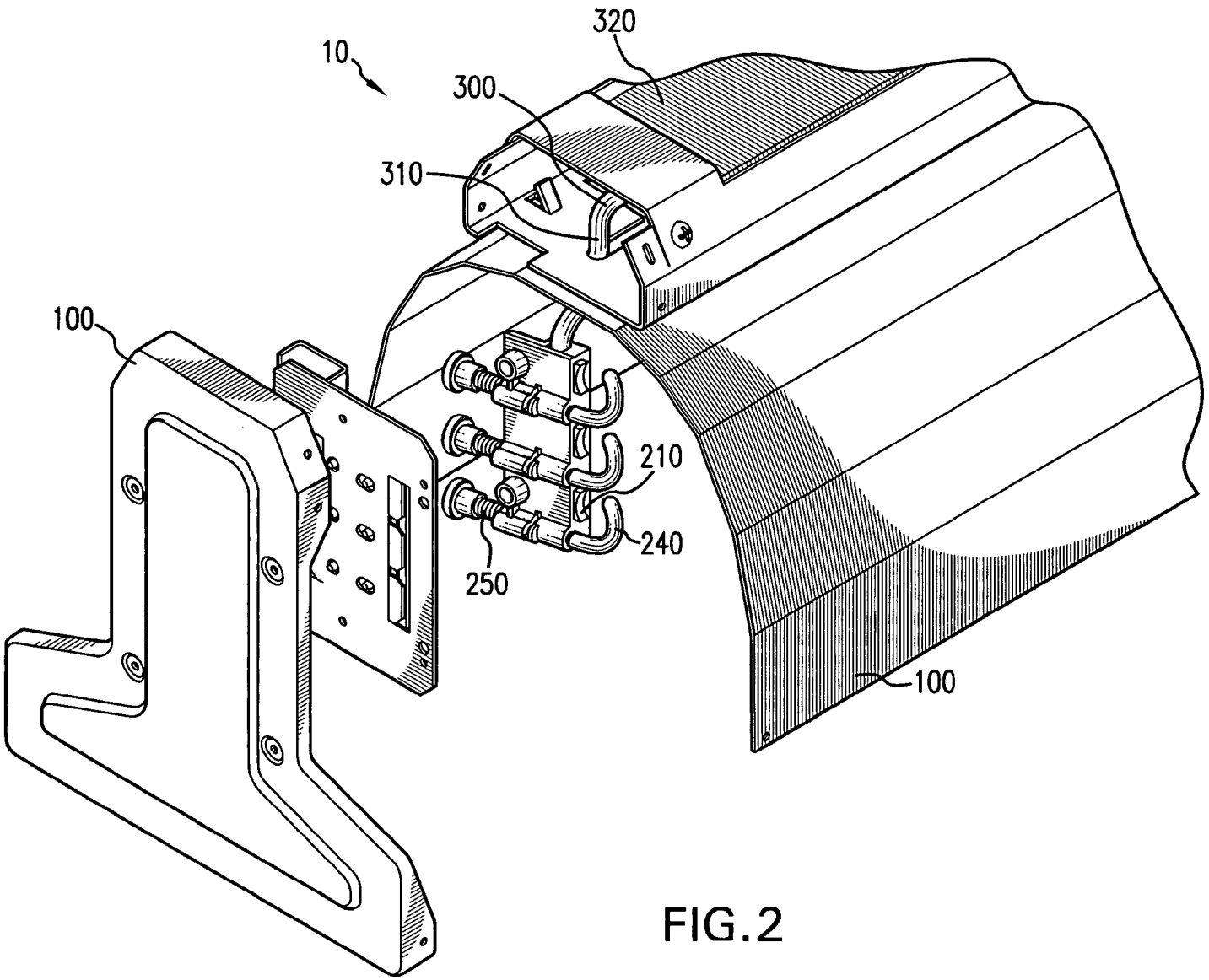
FIG. 2 is an exploded partial perspective view of one embodiment of a fluorescent lighting assembly for mounting at least one fluorescent lamp showing a lamp housing and a lamp retainer.

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used. The preferred embodiments are now described with reference to the figures, in which like reference characters indicate like parts throughout the several views.

Ranges may be expressed herein as from "about" one particular value, and/or to "about" another particular value. When such a range is expressed, an alternate embodiment includes from the one particular value and/or to the other particular value. Similarly, when values are expressed as approximations, by use of the antecedent "about," it will be understood that the particular value forms another embodiment.

In one aspect, the present invention provides a fluorescent lighting assembly 10 for mounting at least one fluorescent lamp 400. The fluorescent lighting assembly 10 comprises a lamp housing 100, in which one or more fluorescent lamps 400 may be mounted.

One aspect of the invention further comprises a thermal contactor 210 mounted within the lamp housing 100. This thermal contactor 210 is constructed to engage a cold spot of the fluorescent lamp 400. If there are multiple fluorescent lamps, there can be an equal number of thermal contactors to engage the cold spot of each lamp. The thermal contactor 210 should comprise a thermally conductive material.

Here, the fluorescent lighting assembly 10 also has a thermal dissipater 300 in thermal contact with the thermal contactor 210. If there are multiple thermal contactors 210, a single thermal dissipater 300 may be in thermal contact with a plurality of, or each of, the thermal contactors. Alternatively, a separate thermal dissipater 300 may be provided for each thermal contactor 210. In this aspect, the thermal dissipater 300 selectively dissipates heat from the fluorescent lamp 400 to the ambient air to maintain the temperature of the cold spot of the fluorescent lamp 400 within a predetermined temperature range.

In one embodiment of the present invention, the thermal dissipater 300 selectively dissipates heat from the fluorescent lamp 400 to the ambient air to maintain the temperature of the cold spot of the fluorescent lamp within a temperature range from about 45° C. to about 57° C. over a range of ambient temperatures of 25° C. and 45° C. It is appreciated that, when the ambient air is above 45° C., the thermal dissipater is continuing to dissipate heat but may not be able to maintain the cold spot of the fluorescent lamp within the desired temperature range.

As one skilled in the art can appreciate, the cold spot of a fluorescent lamp 400 is generally positioned along the length of the lamp at a position predetermined by the lamp manufacturer. However, it is well known that the cold spot can be forced at any position on the lamp. Thus, any spot on the lamp that is maintained at the minimum lamp wall temperature is where the mercury vapor will condense to liquid form.

In yet another aspect of the invention, the thermal dissipater 300 has one or more proximal ends (not shown), each in direct contact with the cold spot of a fluorescent lamp. Should the lamp assembly be constructed to accept multiple lamps, a proximal end of the thermal dissipater would be in contact with the cold spot of each of the lamps. In this case, the thermal dissipater comprises a thermally conductive material. In still another aspect, as one will appreciate, the thermal dissipater may further comprise a plurality of cooling fins 320, or other mechanisms for discharging heat to the ambient environment, to assist in dissipating the heat.

In another embodiment, the fluorescent lighting assembly further comprises a socket 220 for engagement with a mounting end 410 of the fluorescent lamp 400. Lighting assemblies constructed to accept multiple fluorescent lamps can contain a socket for engagement with the mounting end of each fluorescent lamp.

Figure 3:
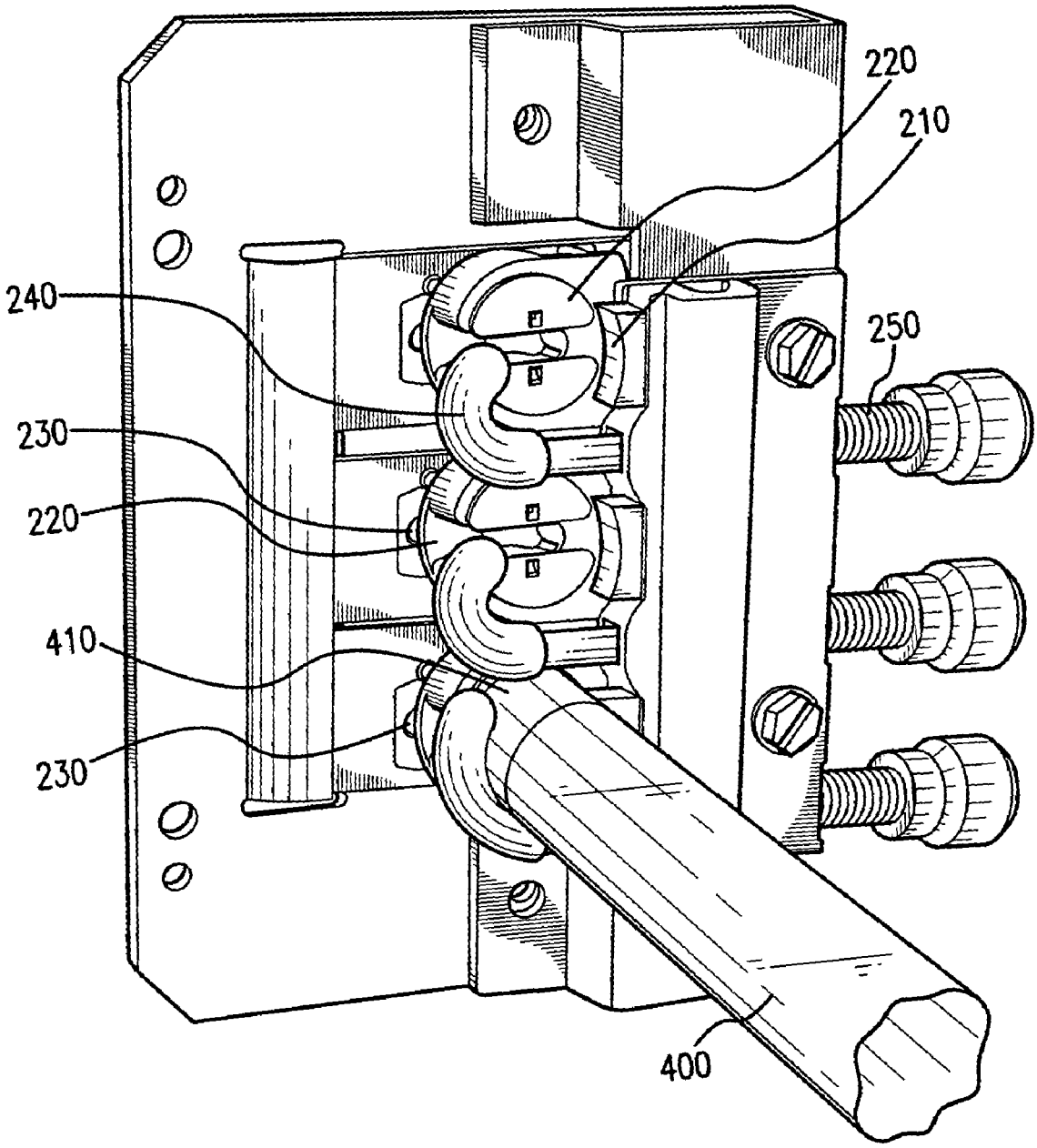
FIG. 3 is a partial perspective view of one aspect of a lamp retainer showing three bias devices, each are constructed to maintain the proper amount of contact pressure between a lamp and a thermal contactor.
Figure 4:
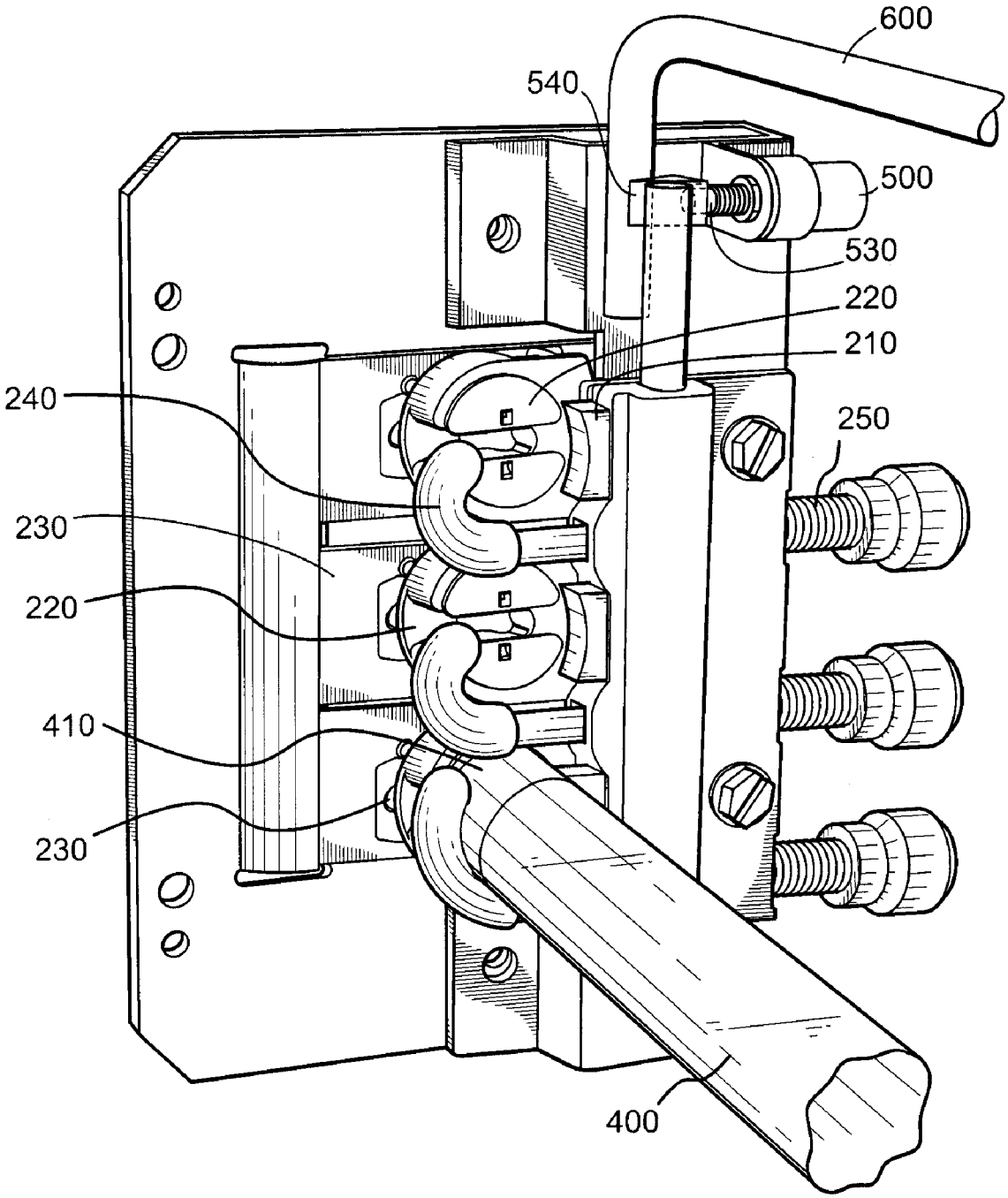
FIG. 4 is a partial perspective view of one embodiment of a fluorescent lighting assembly for mounting at least one fluorescent lamp showing a thermal actuator and a heat pipe.
Figure 5:
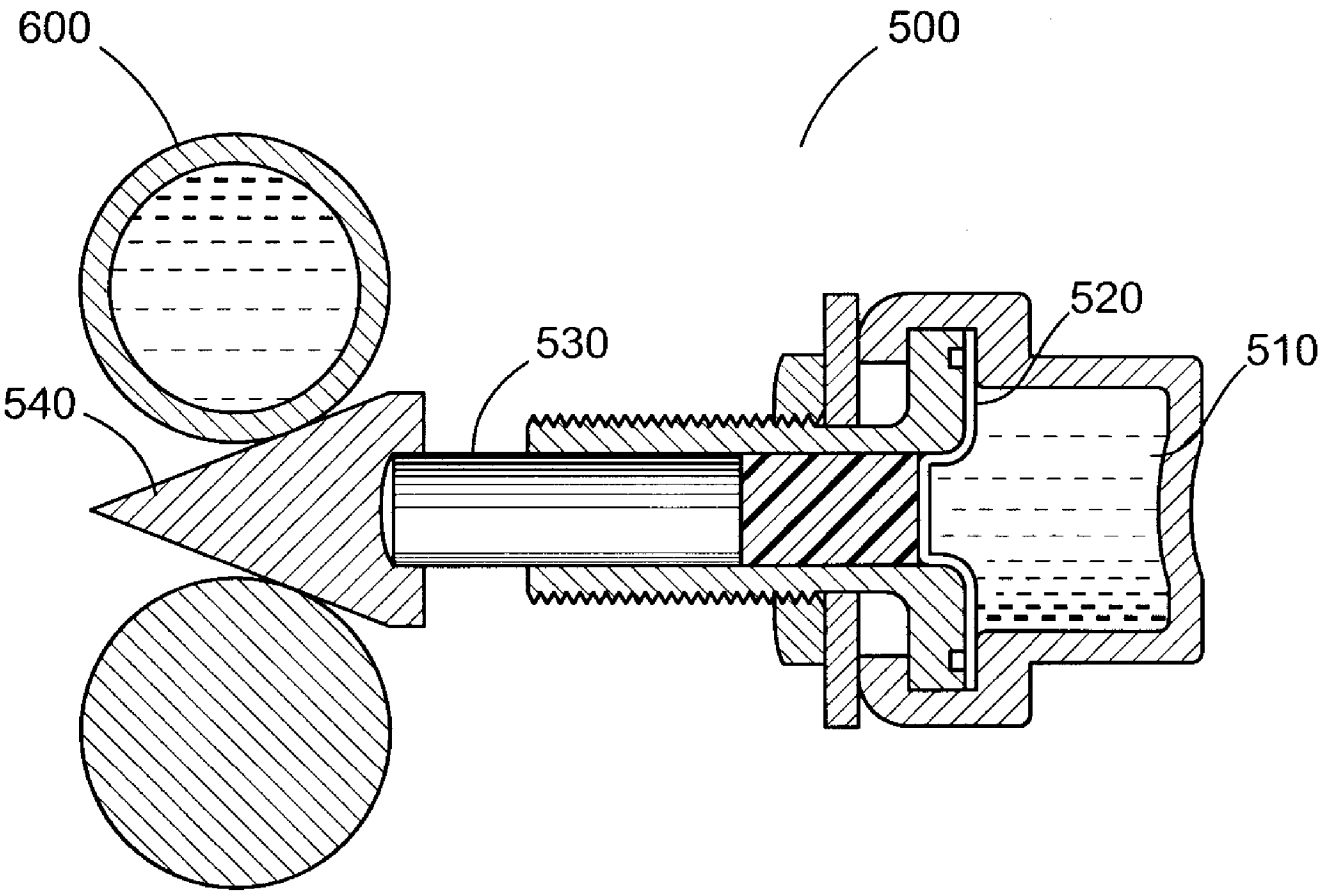
FIG. 5 is a cut-away top elevational view of the thermal actuator in FIG. 4.

In another aspect, the fluorescent lighting assembly 10 may also have a socket receptacle 230 for engagement with each socket 220. This socket receptacle 230 can be mounted to the lamp housing 100. In one embodiment, each socket 220 is slidably received by the socket receptacle 230. As can be seen in FIG. 3, this slidable arrangement allows the socket and the mounting end of the fluorescent lamp engaged within the socket to move along an axis transverse to the thermal contactors. It is contemplated that other embodiments include alternative paths for the socket to move in relation to the thermal contactor. Regardless of how the socket moves in-relation to the thermal contactor, the mobility of the socket permits the fluorescent lamp to be adjusted in order to maintain thermal contact between the cold spot of the fluorescent lamp and the thermal contactors or the proximal end(s) of the thermal dissipater, whichever the case may be.

This embodiment further comprises a lamp retainer 240 for maintaining thermal contact between the thermal contactor(s) 210 and the cold spot of the fluorescent lamp. As can be appreciated, in other embodiments where the lighting assembly has a thermal dissipater with one or more proximal ends in direct contact with the cold spot of the fluorescent lamp(s) in lieu of the one or more thermal contactors, the lamp retainer may be utilized to maintain contact between the proximal end(s) of the thermal dissipater and the cold spot of the fluorescent lamp(s).

In one aspect, the lamp retainer 240 has a bias device 250 to maintain the proper amount of contact pressure between the lamp 400 and the thermal contactor 210. The bias device 250 can be a spring. In one embodiment, the proper amount of contact pressure is 30 pounds per square inch, which results from a spring force of approximately 2 pounds. In other embodiments, the bias device may be any other device that maintains the desired contact between the lamp and the thermal contactor or thermal dissipater.

In one embodiment the thermal dissipater is a variable conductance heat pipe (VCHP) 310. A conventional heat pipe has the disadvantage of dissipating heat only so long as a temperature differential exists between the heat pipe and ambient air. The VCHP 310 can selectively dissipate heat depending on the choice of working fluid. A VCHP operates on the same principles as a conventional heat pipe, except that a reservoir containing a non-condensable gas is added to the heat pipe. By controlling the amount of non-condensable gas inside the reservoir and by careful selection of the heat dissipating area of the heat pipe, a differential thermal transfer is achieved. A boundary region exists between the non-condensable gas and the vaporized working fluid. The location of this boundary region depends on the amount of heat added to the system. At temperatures below the lower end of the desired temperature range, the boundary region is designed to be within the area of the heat pipe where there is no heat dissipating structure. In this case there will be very little heat transfer. Once the cold spot temperature reaches the upper limit of the desired temperature range, the boundary region of the VCHP will move into the area of heat pipe where the heat dissipating structure exists. When this occurs, thermal energy begins to be dissipated. This point is called the set point of the VCHP. As more heat is added, the boundary region moves further and further into the heat dissipating structure allowing greater rejection of heat.

In one aspect, heat is dissipated from the fluorescent lamp to the ambient air using a thermal actuator 500 in conjunction with a conventional heat pipe. This combination creates a mechanical assembly that makes and breaks the thermal transfer path between the fluorescent lamp and the conventional heat pipe. A thermal actuator is a device filled with a wax-like 510 solid that changes from solid to a liquid at a certain temperature. The wax-like material occupies a larger volume in liquid state than in a solid state. When the phase change occurs, the material exerts a force on its container walls. The assembly, as can be appreciated, can be constructed in many ways. One way is to design it such that when expansion occurs, it exerts pressure against a sealed but flexible container wall 520. A cylindrical rod or plunger 530 can be positioned exterior to the container wall such that expansion of the wax-like material, in turn, moves the container wall to move the plunger. The plunger, in turn, can move a small wedge 540 constructed of a thermally conductive material into a position that completes a thermal path between the fluorescent lamp and the heat pipe. Thermal actuators and conventional heat pipes are well known in other applications and will not be discussed further. Common thermal actuators are manufactured and sold by Thermo-Omega-Tech, Inc., Caltherm Corporation, and others.

In still another aspect heat is dissipated from the fluorescent lamp to the ambient air using a localized synthetic jet actuator (SJA) (not shown). As SJA is an air jet generator that requires zero mass input yet produces non-zero momentum output. The basic components of a SJA are a cavity and an oscillating material. A jet is synthesized by oscillatory flow in and out of the cavity via an orifice in one side of the cavity. The flow is induced by a vibrating membrane located on one wall of the cavity. There are many types of actuators that can be used in active flow control, such as thermal, acoustic, piezoelectric, electromagnetic and shape memory alloys. One example of an SJA is well known in the computer field and has been developed by the Georgia Tech Research Corporation and commercialized by Innovative Fluidics, Inc.

In one aspect, a piezoelectric material is chosen to drive the oscillating diaphragm. Flow enters and exits the cavity through the orifice by suction and blowing. On the intake stroke, fluid is drawn into the cavity from the area surrounding the orifice. During one cycle of oscillation, this fluid is expelled out of the cavity through the orifice as the membrane moves upwards. Due to flow separation, a shear layer is formed between the expelled fluid and the surrounding fluid. This layer of vorticity rolls up to form a vortex ring under its own momentum. By the time the diaphragm begins to move away from the orifice to pull fluid back into the cavity, the vortex ring is sufficiently distant from the orifice that it is virtually unaffected by the entrainment of fluid into the cavity. Thus, over a single period of oscillation of the diaphragm, while there is zero net mass flux into or out of the cavity, there is also a non-zero mean momentum flux. This momentum is, effectively, a turbulent-like jet that has been synthesized from the coalescence of a train of vortex rings, or vortex pairs, of the ambient fluid. Flow control can be achieved using traditional devices such as steady and pulsed jets. The obvious benefit of employing SJAs as a flow control device is that they require no air supply and so there is no need for piping, connections, and compressors associated with steady jets. They also consume very little energy.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

We claim:

1. A fluorescent lighting assembly for mounting at least one fluorescent lamp comprising:

a lamp housing;

a thermal contactor mounted within the lamp housing in thermal contact with a cold spot of said fluorescent lamp, said thermal contactor comprising a thermally conductive material;

a thermal dissipater in contact with said thermal contactor; and a means for selectively opening and closing a thermal circuit between the thermal dissipater and the fluorescent lamp to maintain the temperature of the cold spot of the fluorescent lamp within a predetermined temperature range, wherein the thermal dissipater dissipates heat from the fluorescent lamp to the ambient air when the thermal circuit is closed, and wherein the means for selectively opening and closing the thermal circuit selectively opens the thermal circuit without breaking the thermal contact between the thermal contactor and the at least one fluorescent lamp.

2. The fluorescent lighting assembly of claim 1, further comprising a socket for engagement with a mounting end of said fluorescent lamp.

3. The fluorescent lighting assembly of claim 2, further comprising a socket receptacle for engagement with said socket, said socket receptacle being mounted to the lamp housing.

4. The fluorescent lighting assembly of claim 1 for a plurality of fluorescent lamps, further comprising a plurality of thermal contactors wherein each thermal contactor is in thermal contact with said thermal dissipater.

5. The fluorescent lighting assembly of claim 3, wherein said socket is slidably received by said socket receptacle, the socket receptacle further comprising a lamp retainer for maintaining thermal contact between the thermal contactor and the cold spot of the fluorescent lamp.

6. The fluorescent lighting assembly of claim 5, wherein the lamp retainer has a bias device to maintain the proper amount of contact pressure between the lamp and the thermal contactor.

7. The fluorescent lighting assembly of claim 6, wherein the bias device is a spring.

8. The fluorescent lighting assembly of claim 1, wherein the thermal dissipater is a variable conductance heat pipe.

9. The fluorescent lighting assembly of claim 1, wherein the thermal dissipater further comprises a plurality of cooling fins.

10. The fluorescent lighting assembly of claim 1, wherein the means for selectively opening and closing the thermal circuit is configured to allow the thermal dissipater to selectively dissipate heat from said fluorescent lamp to the ambient air to maintain the temperature of the cold spot of said fluorescent lamp within a temperature range from about 45° C. to about 57° C. over a range of ambient temperatures of 25° C. and 45° C.

11. The fluorescent lighting assembly of claim 1, wherein the cold spot of the fluorescent lamp is positioned at a predetermined location along a length of the fluorescent lamp.

12. A fluorescent lighting assembly for mounting at least one fluorescent lamp with a mounting end comprising:

a lamp housing; and a variable conductance heat pipe mounted within the lamp housing having a proximal end, wherein the proximal end comprises a thermally conductive material, and wherein the variable conductance heat pipe is mounted such that the thermally conductive material engages a cold spot of said fluorescent lamp and is configured to selectively open and close a thermal circuit between the variable conductance heat pipe and fluorescent lamp, wherein when the thermal circuit is closed the variable conductance heat pipe dissipates heat from said fluorescent lamp to the ambient air; whereby the selective opening and closing of the thermal circuit maintains the temperature of the cold spot of the fluorescent lamp within a predetermined temperature range.

13. The fluorescent lighting assembly of claim 12, further comprising a socket for engagement with a mounting end of said fluorescent lamp.

14. The fluorescent lighting assembly of claim 13, further comprising a socket receptacle for engagement with said socket, said socket receptacle being mounted to the lamp housing.

15. The fluorescent lighting assembly of claim 12 for mounting a plurality of fluorescent lamps, further comprising a variable conductance heat pipe with a plurality of proximal ends, each comprising a thermally conductive material, wherein each proximal end is in thermal contact with the cold spot of one of the plurality of fluorescent lamps.

16. The fluorescent lighting assembly of claim 14, wherein said socket is slidably received by said socket receptacle, the socket receptacle further comprising a lamp retainer for maintaining thermal contact between the proximal end of the variable conductance heat pipe and the cold spot of the fluorescent lamp.

17. The fluorescent lighting assembly of claim 16, wherein the lamp retainer comprises a bias device to maintain the proper amount of contact pressure between the lamp and the proximal end of the variable conductance heat pipe.

18. The fluorescent lighting assembly of claim 17, wherein the bias device is a spring.

19. The fluorescent lighting assembly of claim 12, wherein the variable conductance heat pipe further comprises a plurality of cooling fins.

20. The fluorescent lighting assembly of claim 12, wherein the variable conductance heat pipe selectively opens and closes the thermal circuit to dissipate heat from said fluorescent lamp to the ambient air to maintain the temperature of the cold spot of said fluorescent lamp within a temperature range from about 45° C. to about 57° C. over a range of ambient temperatures of 25° C. and 45° C.

21. A fluorescent lighting assembly for mounting at least one fluorescent lamp end comprising:

a lamp housing;

a fluorescent lamp mounted within the lamp housing;

a thermal contactor mounted within the lamp housing in thermal contact with a cold spot of said fluorescent lamp, said thermal contactor comprising a thermally conductive material; and a thermal dissipater in contact with said thermal contactor; and a means for selectively opening and closing a thermal circuit between the thermal dissipater and the fluorescent lamp, wherein the thermal dissipater dissipates heat from the fluorescent lamp to the ambient air when the thermal circuit is closed, and wherein the means for selectively opening and closing the thermal circuit selectively opens the thermal circuit without breaking the thermal contact between the thermal contactor and the at least one fluorescent lamp, whereby the selective opening and closing of the thermal circuit results in maintaining the temperature of the cold spot of the fluorescent lamp within a predetermined temperature range.

22. The fluorescent lighting assembly of claim 21, further comprising a socket for engagement with a mounting end of said fluorescent lamp.

23. The fluorescent lighting assembly of claim 22, further comprising a socket receptacle for engagement with said socket, said socket receptacle being mounted to the lamp housing.

24. The fluorescent lighting assembly of claim 21 having a plurality of fluorescent lamps, further comprising a plurality of thermal contactors wherein each thermal contactor is in thermal contact with said thermal dissipater.

25. The fluorescent lighting assembly of claim 23, wherein said socket is slidably received by said socket receptacle, the socket receptacle further comprising a lamp retainer for maintaining thermal contact between the thermal contactor and the cold spot of the fluorescent lamp.

26. The fluorescent lighting assembly of claim 25, wherein the lamp retainer has a bias device to maintain a contact pressure between the lamp and the thermal contactor.

27. The fluorescent lighting assembly of claim 26, wherein the bias device is a spring.

28. The fluorescent lighting assembly of claim 21, wherein the thermal dissipater is a variable conductance heat pipe.

29. The fluorescent lighting assembly of claim 21, wherein the thermal dissipater further comprises a plurality of cooling fins.

30. The fluorescent lighting assembly of claim 21, wherein the means for selectively opening and closing the thermal circuit is configured to allow the thermal dissipater to selectively dissipate heat from said fluorescent lamp to the ambient air to maintain the temperature of the cold spot of said fluorescent lamp within a temperature range from about 45° C. to about 57° C. over a range of ambient temperatures of 25° C. and 45° C.

31. A fluorescent lighting assembly for mounting at least one fluorescent lamp having a cold spot, the assembly comprising:

a lamp housing;

a thermal contactor mounted within the lamp housing to engage the cold spot of said fluorescent lamp, said thermal contactor comprising a thermally conductive material;

a heat pipe mounted within the lamp housing spaced therefrom the thermal contactor;

a thermal actuator mounted within the lamp housing substantially adjacent the space between the heat pipe and the thermal contactor, wherein the thermal actuator defines an internal cavity and comprises:

a plunger having a proximal end and a distal end, the proximal end being positioned within the interior cavity and the distal end being positioned external to the interior cavity;

a thermally conductive member affixed substantially to the distal end of the plunger;

an expandable container disposed within the interior cavity of the thermal actuator, wherein a portion of the expandable container is positioned substantially adjacent the proximal end of the plunger, the expandable container enveloping a phase change material, wherein the phase change material exerts an expansion force on the container walls when the phase change material changes from a solid to a liquid, thereby expanding at least a portion of the expandable container and wherein expansion of the container causes the plunger to move from a first, non-actuated position, in which the thermally conductive member is not in thermal contact with the heat pipe and the thermal contactor, and a second, actuated position, in which the plunger extends and moves the thermally conductive member into a position whereby it is in thermal contact with the thermal contactor and the heat pipe.

32. The fluorescent lighting assembly of claim 31, wherein the heat pipe further comprises a plurality of cooling fins.

33. A fluorescent lighting assembly for mounting at least one fluorescent lamp having a cold spot, the assembly comprising:

a lamp housing;

a heat pipe mounted within the lamp housing such that at least a portion of the heat pipe is positioned exterior to the lamp housing;

a thermal contactor mounted within the lamp housing to engage the cold spot of said fluorescent lamp, said thermal contactor comprising a thermally conductive material a thermal actuator mounted within the housing adjacent to the thermal contactor and the heat pipe, the thermal actuator spaced therefrom at least one of the heat pipe or the thermal contactor, the thermal actuator comprising:

a plunger having a distal end and a longitudinal axis, wherein the plunger is slidably mounted in a wall of the thermal actuator and is adapted to translate along its longitudinal axis relative to the thermal actuator;

a thermally conductive member affixed substantially to the distal end of the plunger;

a means for moving the plunger from a first, non-actuated position, in which the thermally conductive member is not in thermal contact with the heat pipe and the thermal contactor, and a second, actuated position, in which the plunger extends and moves the thermally conductive member into a position whereby it is in thermal contact with the thermal contactor and the heat pipe thereby completing a thermal circuit from the cold spot of the fluorescent lamp to the heat pipe.

34. A fluorescent lighting assembly for mounting at least one fluorescent lamp comprising:

a lamp housing;

a thermal contactor mounted within the lamp housing to engage a cold spot of said fluorescent lamp, said thermal contactor comprising a thermally conductive material; and a variable conductance heat pipe in thermal contact with said thermal contactor, wherein said variable conductance heat pipe is configured to selectively open and close a thermal circuit between the variable conductance heat pipe and fluorescent lamp, wherein the variable conductance heat pipe dissipates heat from said fluorescent lamp to the ambient air to maintain the temperature of the cold spot of said fluorescent lamp within a predetermined temperature range when the thermal circuit is closed.

* * * * *